US005425537A

United States Patent [19]

Vogelsang

[11] Patent Number: 5,425,537

[45] Date of Patent: Jun. 20, 1995

[54] METHOD FOR PLAYING A DICE GAME

[76] Inventor: Kieth A. Vogelsang, 6020 Oakwood Dr. Apt. 1E, Lisle, Ill. 60532

[21] Appl. No.: 327,606

[22] Filed: Oct. 24, 1994

[51] Int. Cl.[6] ..... A63F 9/04

[52] U.S. Cl. ..... 273/146

[58] Field of Search ..... 273/146

[56] References Cited

U.S. PATENT DOCUMENTS

| | | | |
|---|---|---|---|
| 1,419,056 | 6/1922 | Kaufman | 273/146 |
| 3,195,895 | 7/1965 | Kropinski | 273/146 |
| 3,959,893 | 6/1976 | Sigg | 273/146 |
| 4,346,900 | 8/1982 | Lamlee | 273/274 |
| 4,635,938 | 1/1987 | Gray | 273/274 |
| 4,648,602 | 3/1987 | Maroney | 273/146 |
| 5,145,175 | 9/1992 | Gathman et al. | 273/146 |

FOREIGN PATENT DOCUMENTS

| | | | |
|---|---|---|---|
| 2437853 | 6/1980 | France | 273/146 |

OTHER PUBLICATIONS

Scarne's Encyclopedia of Games by John Scarne, "Scarney Dice", pp. 486–488, Harper & Row Publishers, 1973.

*Primary Examiner*—Benjamin H. Layno

*Attorney, Agent, or Firm*—Patnaude, Videbeck & Marsh

[57] ABSTRACT

A game is played by rolling a plurality of multi-faced dice and accumulating a total of the numbers shown on the up faces of the dice. One face of each die bears a symbol, and the player loses the points accumulated during his turn if one of the dice displays a symbol as a result of having been rolled, and the player loses all of his points if both of the dice displays the symbols as a result of the roll.

1 Claim, 1 Drawing Sheet

METHOD FOR PLAYING A DICE GAME

The present invention relates to a game for entertaining a plurality of players, and specifically to a game played with a pair of multi-faced dice.

BACKGROUND OF THE INVENTION

It is desirable to provide a dice game which is easily played by a number of players, and is readily transportable. Such a game may be played whenever two or more individuals seek common entertainment.

SUMMARY OF THE INVENTION

Briefly, the game of the present invention is played by a plurality of players and is played with a pair of multi-faced dice. Each of the dice has a discernible upwardly directed face, or up face when the dice is in a rest position, and one of the faces of each of the dice bears a symbol thereon. All remaining faces of each dice has a number printed thereon where the number of faces having even numbers printed thereon is within one digit of the number of faces having an odd number printed thereon.

The game is played by each of the plurality of players electing to count either the class of the sum of the numbers displayed on the up faces of the dice which total an even number or the class of the sum of numbers displayed on the dice which total an odd number. Thereafter, the players successively take turns for the rolling of the dice, each turn of a player consisting of one or more rolls of the pair of dice until his or her respective turn is terminated or until the player has reached a given accumulated score.

In accordance with the present invention, each turn of a player consists of rolling the pair of dice and summing the numbers displayed on the up faces of the dice. If neither of the up faces of the pair of dice displays its symbol, and the sum of the numbers on the up faces is of the class elected by the player whose turn is being taken, the sum of the numbers on the up faces of the dice is added to a subtotal of points accumulated within the turn, and the player rolls the dice again. If neither of the up faces of the pair of dice displays a symbol, and the sum of the numbers on the up faces is not of the class elected by the player whose turn is in process, the player adds the subtotal of points he or she has accumulated within the turn to a total of points for the player and his turn is terminated. If one of the up faces of the pair of dice displays a symbol, the player whose term is in process forfeits the subtotal of accumulated points accumulated during the player's turn, and his or her turn is terminated. If both of the up faces of the pair of dice display symbols, the player whose turn is in process forfeits both the subtotal of points accumulated during the player's turn and the total of accumulated points of the player, and his or her term is terminated.

In the preferred embodiment the game is played with a pair of dice having pentagon shaped faces for a total of 12 faces on each of the dice. One of the faces of each dice is marked with a symbol, such as the symbol of a peanut. Another of the faces can bear a zero or any name or symbol for the identification of the game, and the numerical value of that face is counted as zero. The remaining 10 faces of each dice are numbered from one to ten.

BRIEF DESCRIPTION OF THE DRAWINGS

A better understanding of the present invention can be had by a reading of the following detailed description taken in conjunction with the drawings wherein.

DETAILED DESCRIPTION OF THE PREFERRED EMBODIMENT

Figure 1:
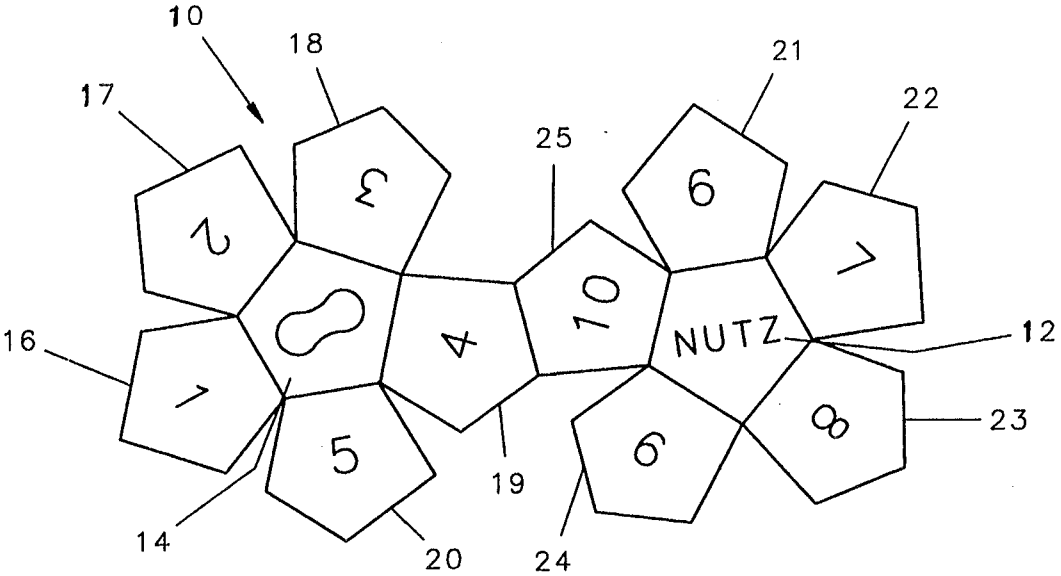
FIG. 1 is a disassembled plan view of a 12 sided dice.
Figure 2:
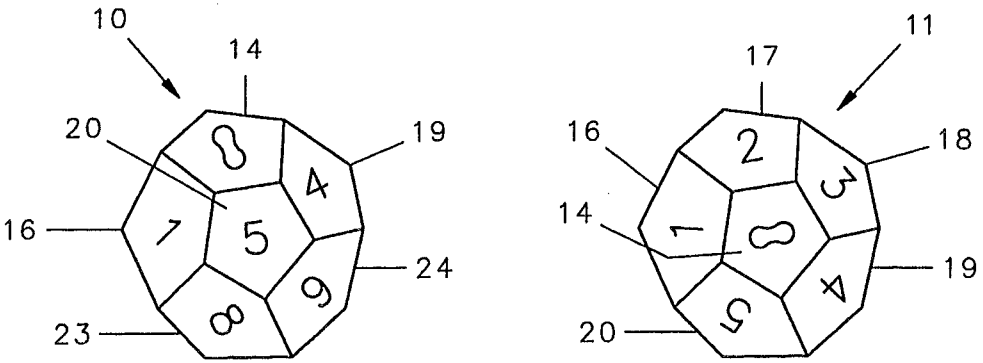
FIG. 2 is a perspective view of a pair of dice to be used in accordance with the game of the present invention.

Referring to FIG. 1, the game is played with a pair of multi-faced dice which in the preferred embodiment are the identical twelve-face dice 10 and 11 shown in FIGS. 1 and 2. Two of the faces on each dice are unnumbered, and in the preferred embodiment, one face 12 bears a first symbol, such as the word "Nut" and a second face 14 bears a second symbol, in this case the design of a peanut. The remaining faces numbered 16 through 25 are assigned a numerical value and bear successive numbers thereon commencing with the number 1 and extending to the number 10. It should be appreciated that although the faces are shown as bearing numerals, the number could be identified by a series of dots or other marks which identify the number of points to be attributed to the face. Each of the dice 10 may have any number of faces but, as shown in FIG. 2, when the dice 10 is at rest, there must be an upwardly directed face, such as face 12 on dice number 10, or face 17 of dice number 11. The numberings of the faces may not be successive, however, the number of even numbered faces on each die should be within one integer of the number of odd numbered faces on each die. It should be noted that although dice 10 and 11 each show 10 numbered faces, the unnumbered faces marked with the second symbol, the peanut, have a numerical value equal to zero and are treated as even numbers.

Two or more players are needed for the game, and each player elects to count either the class of even numbers which are the sum of the numbers displayed in the up faces of the two dice, or the class of odd numbers which are the sum of the numbers displayed on the up faces of the dice after each roll of the player whose turn is in progress. It is not necessary that one player elect to count the class of even sums and that another play select the class of odd sums, but it is necessary that the chosen class of each player be announced at the commencement of the game.

Thereafter, a first player begins a turn at rolling the dice 10 and 11 and counting the sum of numbers displayed on the up faces of the two dice and where permitted, adding the numbers accumulated during the turn to his or her accumulated score when the turn is terminated. Thereafter, the dice are transferred to a second player who undertakes a similar turn, and at the expiration thereof is moved either to a third player and so on until each player has had a turn, after which the dice are returned to the first player and the succession of turns is repeated. During each turn of a player, the pair of dice are rolled and allowed to come to rest displaying the up faces thereof.

If neither of the up faces of the pair of dice displays the first symbol depicted on face 12, and the sum of the numbers of the dice 10, 11 is of the class elected by the player, that sum is added to a subtotal of points accumulated by the player within his or her turn, and the player is allowed to roll the dice again. If neither of the up faces of the pair of dice displays the first symbol of face 12, and the sum of the numbers on the up faces is not of the class elected by the player, then the player will add the subtotal of points accumulated within his current turn to his total points accumulated during the game and his or her turn is terminated. If one of the up faces of the pair of dice displays the first symbol of face 12, the player will forfeit the subtotal of the points accumulated during his or her current turn and his or her turn is terminated. Finally, if both up faces of the pair of dice display the first symbol shown in face 12, the player will forfeit all his or her points, both the accumulated total and the subtotal accumulated during the current turn, and the player's turn is terminated. In the preferred embodiment where the first symbols on face 12 of each of the dice is the word "Nutz", the player is said to have "gone nuts" and he or she is required to forfeit all of his or her points. If the second symbol appears on the up face of any dice, that die is treated as though the up face has a value of zero.

On the termination of a player's turn, the dice are passed to the next successive player until all players have played, and thereafter returned to the first player and the succession of turns is repeated. The game continues until one of the players has reached a given number, such as 100 points at which time that player is declared the winner.

In a preferred embodiment, the dice are made sufficiently large such that the numbers, symbols and words displayed thereon can be easily seen. Furthermore, the dice are made of a hardened rubberized material to provide a high degree of bounce for the dice so as to heighten interest in the movement of the dice on each roll.

It should be appreciated that although the present invention is depicted as embodying twelve-sided dice, dice may be used which bear any number of sides.

While the present invention has been described in connection with a single embodiment, it will be understood that many changes and modifications thereof may be made without departing from the true spirit and scope of the present invention, and it is intended by the appended claims to cover all such changes and modifications which come within the true spirit and scope of the invention.

What is claimed:

1. The method of playing a game with a plurality of players comprising the steps of:

providing a pair of dice, each of said dice having a plurality of faces and a discernible up face when said dice are in an at rest position, one of said plurality of faces of each of said dice having a symbol thereon, all remaining of said plurality of faces of said dice having a numerical value where the number of said faces bearing an even numerical value is within one digit of the number of said faces bearing an odd numerical value, each of said players of said plurality of players electing a class which are the odd numbered sums of said numerical values of said up faces of said pair of dice during a single roll, or the class of the even numbered sums of said numerical values of said up faces of said pair of dice, said plurality of players successively taking turns for the rolling of dice, and each of said players continuing to roll said dice until the expiration of said players turns, said players successively taking turns for the rolling of the dice until one of said plurality of players has reached a given accumulated score, each of said turns of said players comprising:

rolling said pair of dice and summing said numerical values of said up faces of said pair of dice, if neither of said up faces of said pair of dice displays said symbol, and said sum of said numerical values is of said class elected by said player whose turn is in progress, adding said sum to a subtotal of points accumulated within said turn and rolling said pair of dice again, if neither of said up faces of said pair of dice displays said symbol and said sum of said numerical values of said up faces is not of said class elected by said player whose turn is in progress, adding said subtotal of points accumulated within said turn to a total of points for said player and terminating said turn, if one of said up faces of said pair of dice displays said symbol, forfeiting said subtotal of accumulated points and terminating said turn of said player, and if both of said up faces of said pair of dice display said symbol, forfeiting both said subtotal of said points and said total of said points, and terminating said turn.

* * * * *